US005991937A

United States Patent [19]

Safara

[11] Patent Number: 5,991,937

[45] Date of Patent: Nov. 30, 1999

[54] BIDET DEVICE

[76] Inventor: Stephen G Safara, 14 Verly Ct., Bethpage, N.Y. 11714

[21] Appl. No.: 09/037,831

[22] Filed: Mar. 10, 1998

[51] Int. Cl.[6] ..... A61H 35/00; A47K 3/22

[52] U.S. Cl. ..... 4/420.2; 4/420.4; 4/448; 4/903; 239/315

[58] Field of Search ..... 4/443, 420.2, 420.4, 4/448, 420, 420.1, 420.3, 420.5, 444–447, 615, 903; 239/315, 316

[56] References Cited

U.S. PATENT DOCUMENTS

| | | | |
|---|---|---|---|
| 3,259,321 | 7/1966 | Sellers | 239/316 X |
| 3,662,407 | 5/1972 | Colucci | 4/420.2 |
| 3,759,284 | 9/1973 | Crowley et al. | 239/315 X |
| 4,092,744 | 6/1978 | Butoi | 4/420.2 X |
| 4,422,189 | 12/1983 | Couvrette | 4/443 X |
| 4,596,058 | 6/1986 | Nourbakhsh | 4/448 |
| 4,622,704 | 11/1986 | Chung | 4/448 X |
| 4,761,837 | 8/1988 | Takeda | 4/443 |
| 4,807,311 | 2/1989 | Ingels | 4/443 |
| 4,890,340 | 1/1990 | Lovitt | 4/443 |
| 4,903,347 | 2/1990 | Garcia et al. | 4/420.4 |
| 5,023,961 | 6/1991 | Alonso | 4/448 |
| 5,090,067 | 2/1992 | Cogdill | 4/420.4 X |
| 5,305,476 | 4/1994 | Ohyama et al. | 4/615 X |
| 5,562,248 | 10/1996 | Khalifka | 4/903 X |
| 5,685,028 | 11/1997 | Miller et al. | 4/443 |
| 5,716,005 | 2/1998 | McMahan | 239/315 |

FOREIGN PATENT DOCUMENTS

| | | | |
|---|---|---|---|
| WO9403974 | 4/1991 | Australia | 4/443 |

*Primary Examiner*—Henry J. Recla
*Assistant Examiner*—Kathleen J. Prunner
*Attorney, Agent, or Firm*—Michael I. Kroll

[57] ABSTRACT

A bidet device (10) includes a hand held spray member (12). An assembly (14) is for supplying a source of warm water to the hand held spray member (12), so that the warm water can be ejected from the hand held spray member (12) and be directed to a crotch area of a female person over a bowl (16) of a conventional toilet (18). An assembly (20) is for supplying a source of warm air to the hand held spray member (12), so that the warm air can be ejected from the hand held spray member (12) and be directed to the crotch area of the female person to dry the crotch area. An assembly (22) in the hand held spray member (12) is for supplying a source of liquid soap, so that the liquid soap can be ejected from the hand held spray member (12) and be directed to the crotch area of the female person to help clean the crotch area.

19 Claims, 7 Drawing Sheets

BIDET DEVICE

BACKGROUND OF THE INVENTION

1. Field of the Invention

The instant invention relates generally to toilet hygienic accessories and more specifically it relates to a bidet device. The bidet device includes a hand held spray head used in conjunction with a standard toilet to be directed to a crotch area of a female body, so as to reduce the use of toilet paper and soiled underwear during a menstrual cycle. The bidet device can be utilized for medical and other female personal nature requirements.

2. Description of the Prior Art

Numerous toilet hygienic accessories have been provided in prior art. For example, U.S. Pat. Nos. 4,596,058 to Nourbakhsh; 4,761,837 to Takeda; 4,890,340 to Lovitt and 5,023,961 to Alonso all are illustrative of such prior art. While these units may be suitable for the particular purpose to which they address, they would not be as suitable for the purposes of the present invention as heretofore described.

NOUREAKHSH, MAHMOUD M.

BIDET ATTACHMENT FOR WATER CLOSETS

U.S. Pat. No. 4,596,058

This patent discloses a bidet attachment for a conventional water closet. An open compartment is formed at one end of the water tank to receive a water mixing chamber which receives water from incoming hot and cold supply lines. The entry of hot and cold water into the mixing chamber is controlled by valve control handles on the side of the compartment. An outlet pipe extends from the mixing chamber to the overfill pipe of the water tank and is accessible so that the water temperature can be sensed by touching the outlet pipe. A hand held spray is carried on the end of a flexible hose which can be retracted into the compartment for storage. A control button on the spray head can be activated to divert water from the outlet pipe to the hose for application of a bidet spray from the spray head, with the toilet bowl serving as the bidet basin.

TAKEDA, HISANOBU

WASHING DEVICE FOR PARTS OF BODY

U.S. Pat. No. 4,761,837

A washing device for parts of the body comprises a pump means to supply water from a water source under pressure and a nozzle means which spouts the pressurized water against the private parts of the human body as a water jet. Since the pump means has an air intake port on the suction side, air foam is securely mixed in the water jet. Also, since an air control valve is provided in connection with the air intake port, the mixing ratio of the air in the water can be controlled by the air control valve.

LOVITT, HAROLD B.

SELF-CONTAINED HAND-HELD BIDET

U.S. Pat. No. 4,890,340

This patent discloses a self-contained hand-held bidet device, for providing lavaging action with portability and convenience. The device comprises a housing having a motorized pump with a power source and switch for activating the pump. The pump draws fluid from a reservoir mounted at one end of the housing and pumps the fluid through a pivotal conduit to exit as a spray. Lightweight construction, a collapsible reservoir and the pivotally mounted wand facilitate convenient storage.

ALONSO, NELSON A.

BIDET ACCESSORY

U.S. Pat. No. 5,023,961

This patent discloses a bidet accessory for mounting to the rear flanged section of two-piece toilet fixtures and removably connected to hot and cold water supplies. An outlet is connected through a flexible conduit to a sprayer that is, when not in use, held in place by the supporting assembly. A mounting assembly is mounted to the supporting assembly and it allows for the installation of the bidet accessory in a multitude of different angles depending on the users' preferences and space constraints.

SUMMARY OF THE INVENTION

A primary object of the present invention is to provide a bidet device that will overcome the shortcomings of the prior art devices.

Another object is to provide a bidet device that includes a hand held spray member used in conjunction with a conventional toilet to be directed to a crotch area of a female body, so as to reduce the use of toilet paper and soiled underwear during a menstrual cycle.

An additional object is to provide a bidet device that can be utilized for medical and other female personal nature requirements.

A further object is to provide a bidet device that is simple and easy to use.

A still further object is to provide a bidet device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views: and wherein.

Similar reference characters denote corresponding features consistently throughout the attached drawings.

Figure 1:
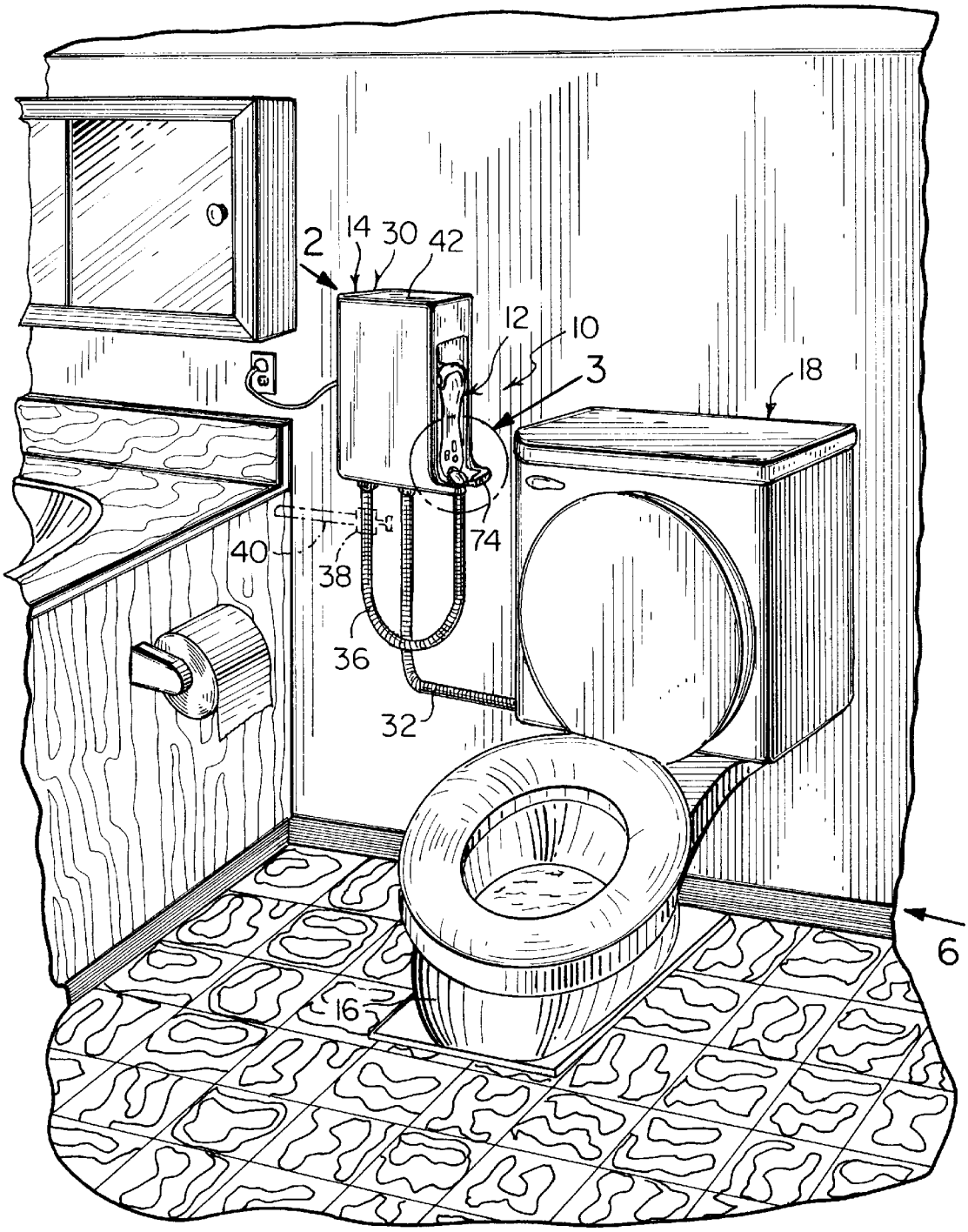
FIG. 1 is a perspective view showing the present invention installed in a bathroom.
Figure 2:
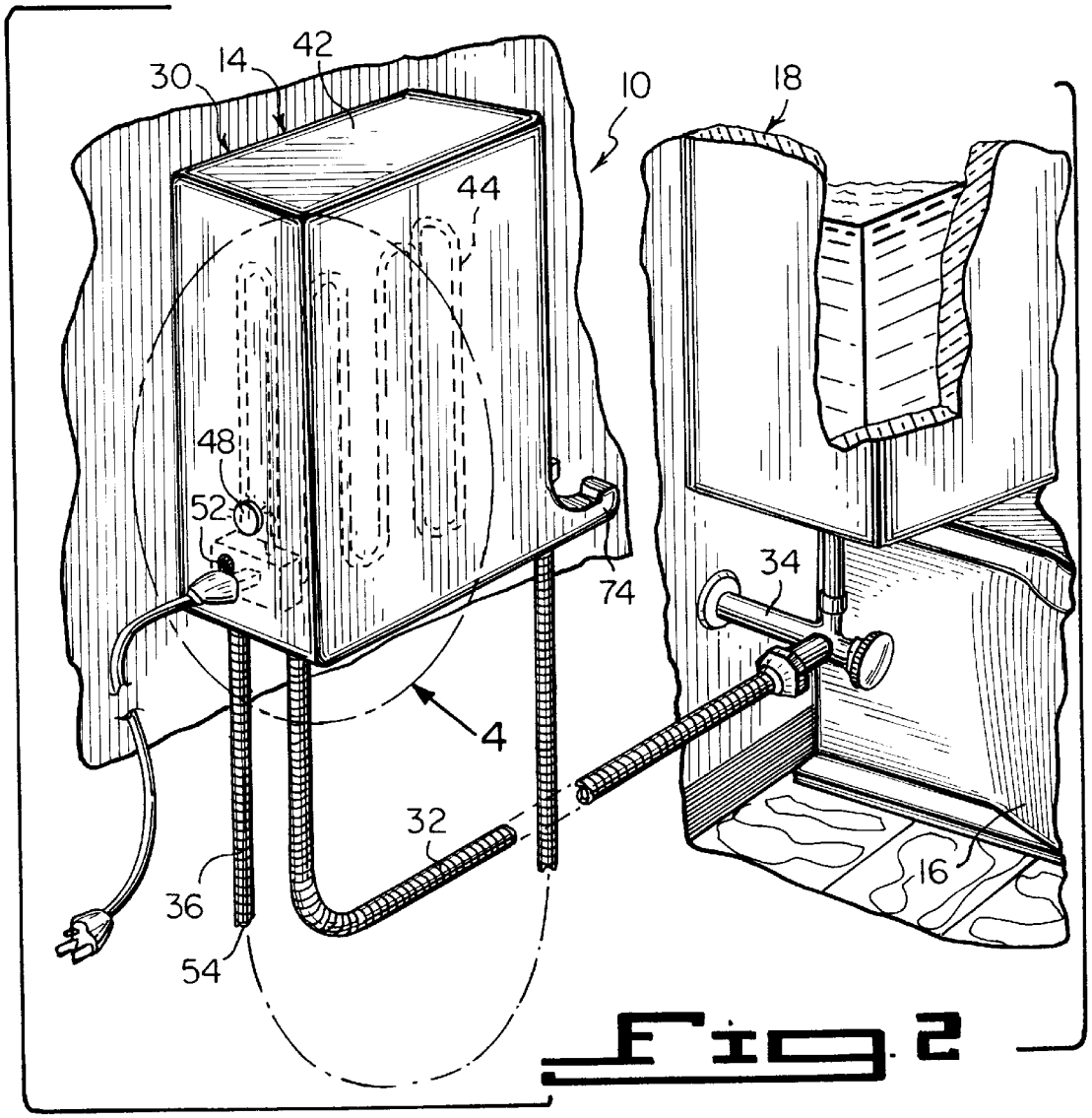
FIG. 2 is an enlarged perspective view taken in the direction of arrow 2 in FIG. 1, with parts broken away and in section.
Figure 3:
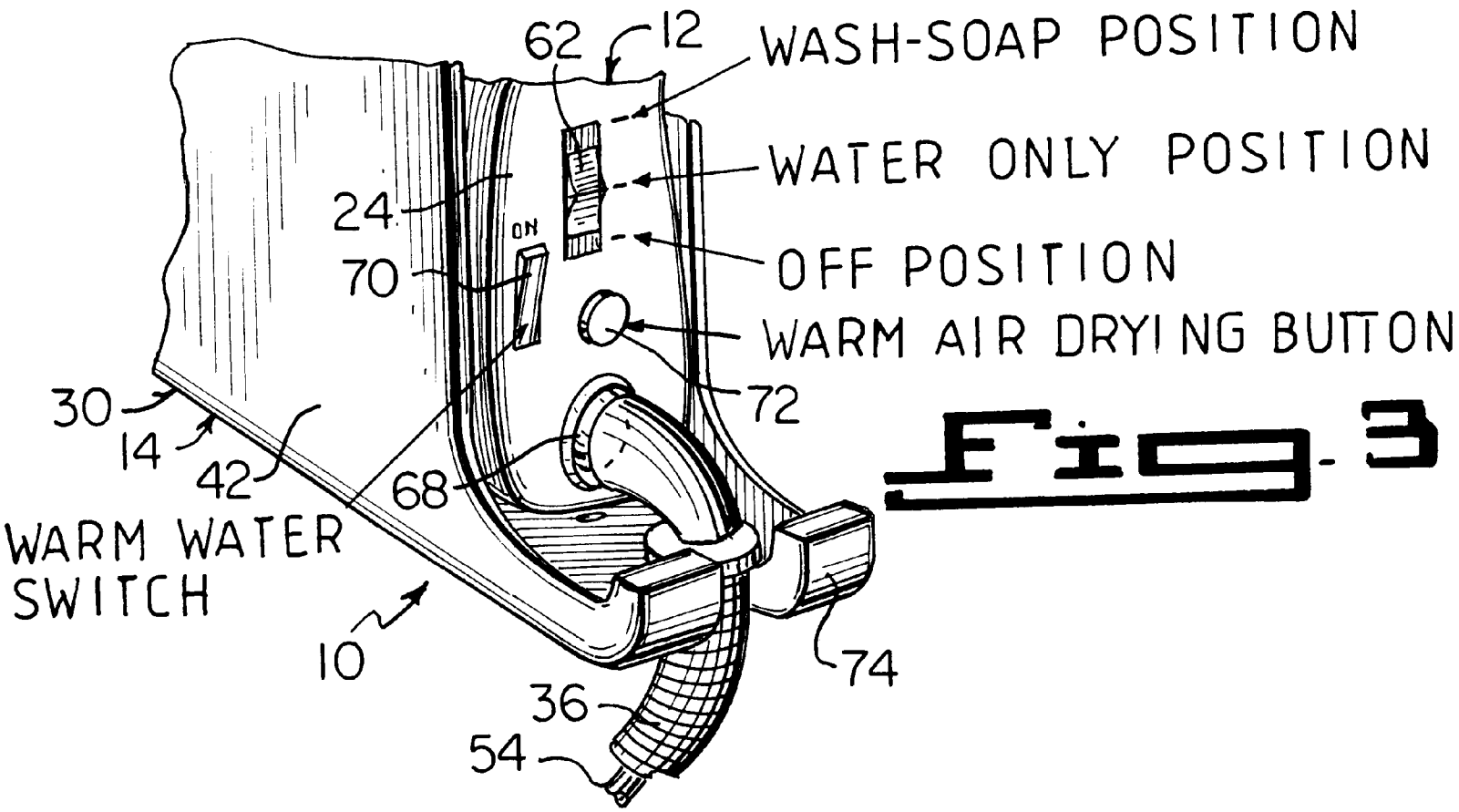
FIG. 3 is an enlarged perspective view of an area in FIG. 1, indicated by arrow 3.

The bidet device 10 comprises a hand held spray member 12. An assembly 14 is for supplying a source of warm water to the hand held spray member 12, so that the warm water can be ejected from the hand held spray member 12 and be directed to a crotch area of a female person over a bowl 16 of a conventional toilet 18. An assembly 20 is for supplying a source of warm air to the hand held spray member 12, so that the warm air can be ejected from the hand held spray member 12 and be directed to the crotch area of the female person to dry the crotch area. An assembly 22 in the hand held spray member 12 is for supplying a source of liquid soap, so that the liquid soap can be ejected from the hand held spray member 12 and be directed to the crotch area of the female person to help clean the crotch area.

Figure 6:
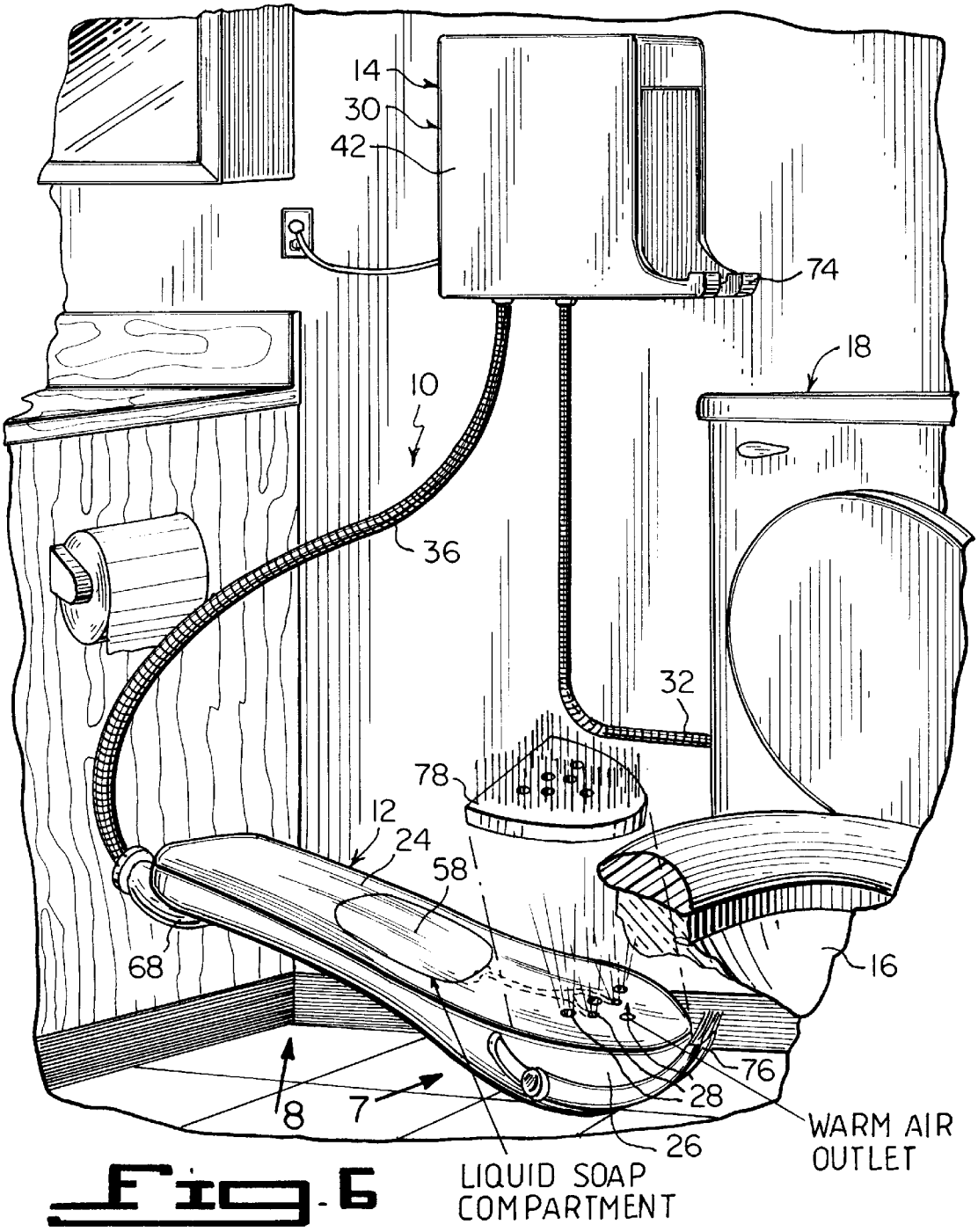
FIG. 6 is an enlarged perspective view taken in the direction of arrow 6 in FIG. 1, with parts broken away and in section, showing the hand held spray head removed from the cradle.
Figure 7:
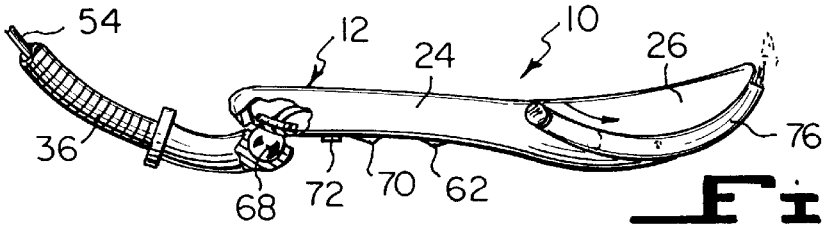
FIG. 7 is a side view of the hand held spray head taken in the direction of arrow 7 in FIG. 6, with parts broken away and in section.

The hand held spray member 12, as best seen in FIG. 6, includes a handle 24 with a spray head 26 having a plurality of outlet ports 28. At least one of the outlet ports 28 will eject the warm water therefrom. At least one of the outlet ports 28 will eject the warm air therefrom, and at least one of the outlet ports 28 will eject the liquid soap therefrom.

The warm water supplying assembly 14 consists of a water heater 30. A first flexible water hose 32 is fluidly connected between a cold water supply line 34 and the water heater 30. A second flexible water hose 36 is fluidly connected between the water heater 30 and the hand held spray member 12. The warm water supplying assembly 14 can further include a water control valve 38 on the second flexible water hose 36 fluidly connected to a hot water supply line 40, as shown in phantom in FIG. 1.

The water heater 30 contains a reservoir 42. An electrical heating unit 44 is in the reservoir 42, for heating water 46 in the reservoir 42. A temperature control knob 48 on the reservoir 42 is for adjusting the electrical heating unit 44.

Figure 4:
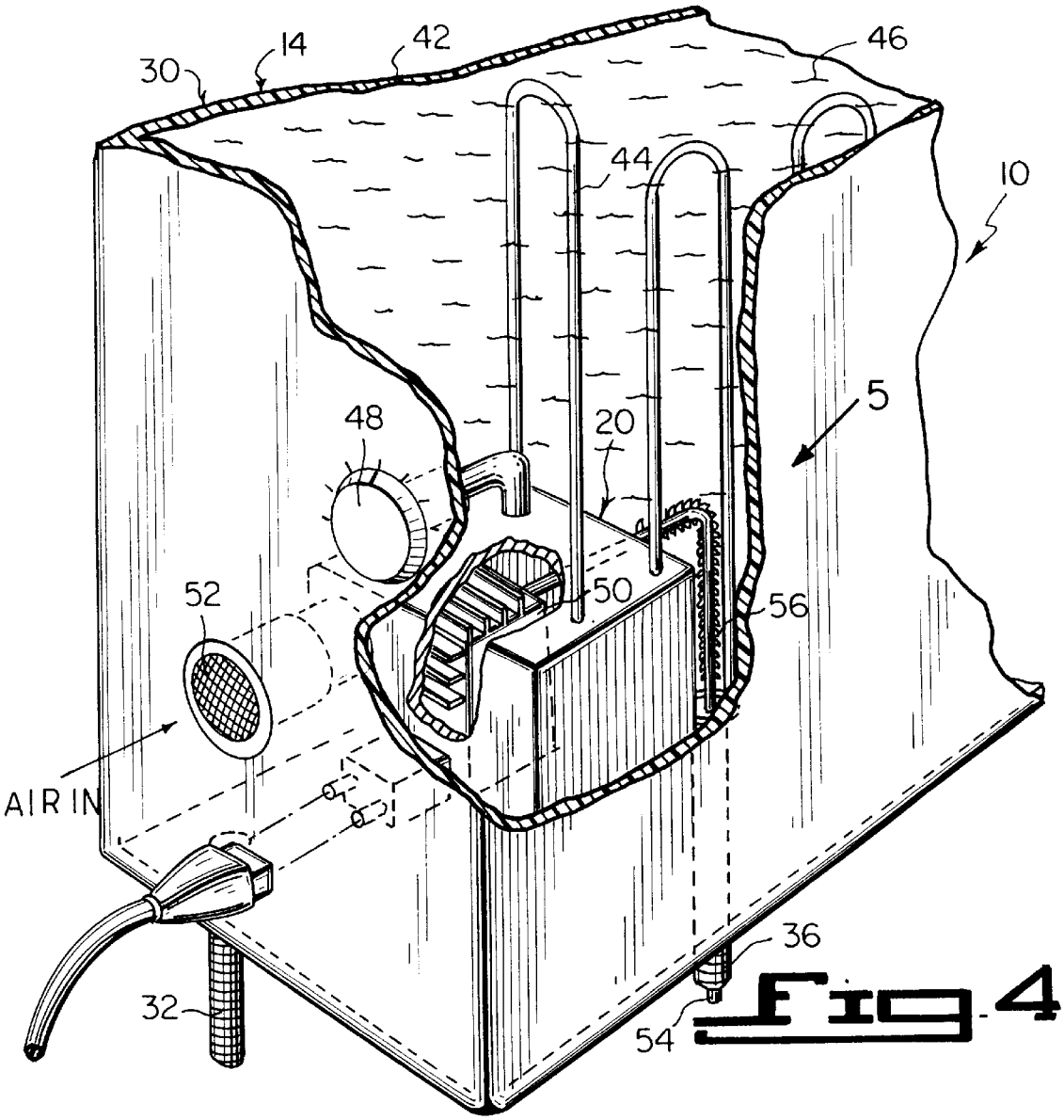
FIG. 4 is an enlarged perspective view of an area in FIG. 2, indicated by arrow 4, with parts broken away and in section.
Figure 5:
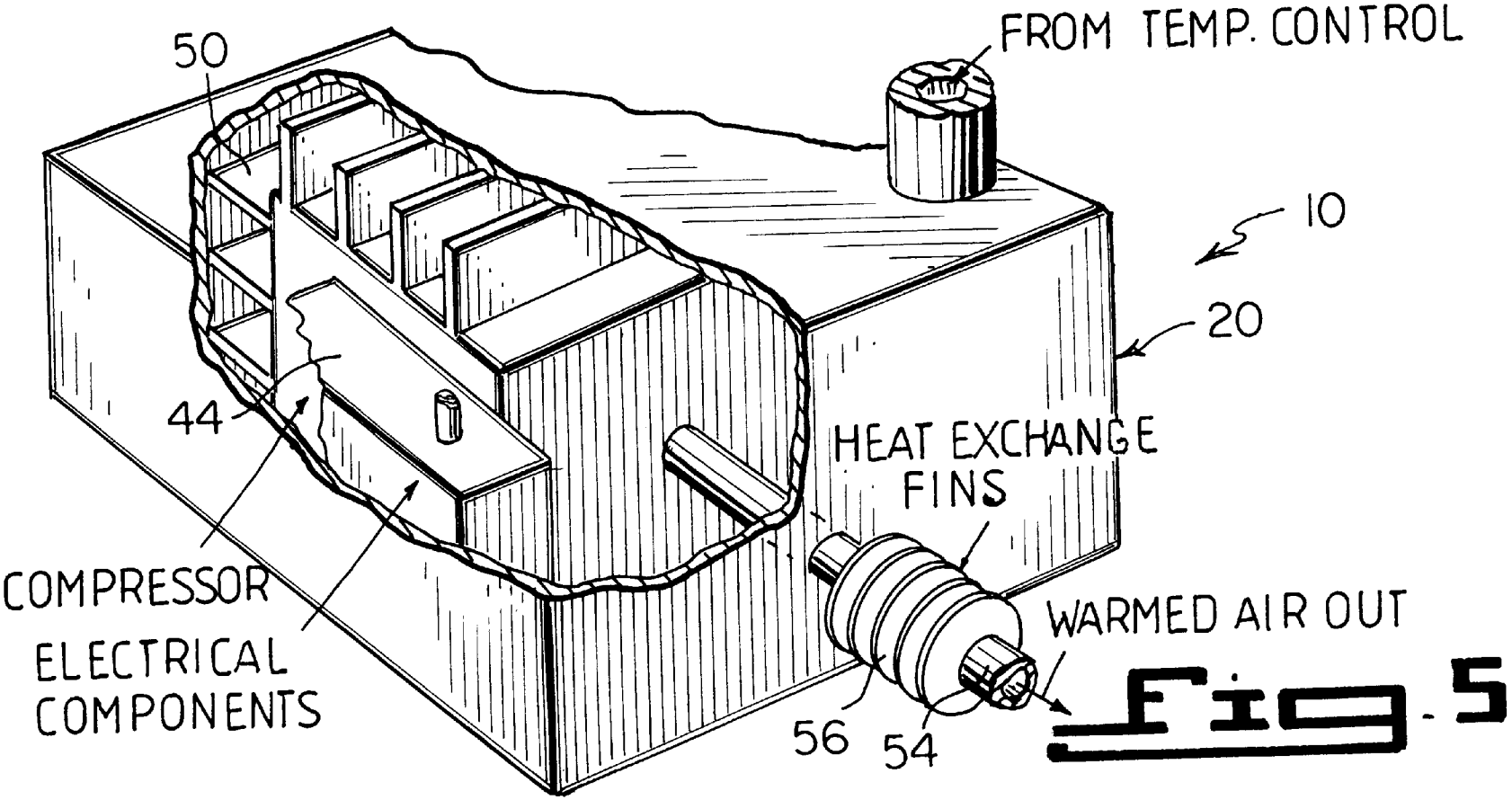
FIG. 5 is a perspective view taken in the direction of arrow 5 in FIG. 4, with parts broken away and in section.

The warm air supplying assembly 20, as best seen in FIGS. 4 and 5, includes a compressor 50 in the reservoir 42. An air inlet vent 52 on the reservoir 42 is fluidly connected to the compressor 50. A flexible air outlet pipe 54 extends from the compressor 50 through the second flexible water hose 36 to the hand held spray member 12. A plurality of heat exchange fins 56 are on the flexible air outlet pipe 54 within the reservoir 42.

Figure 8:
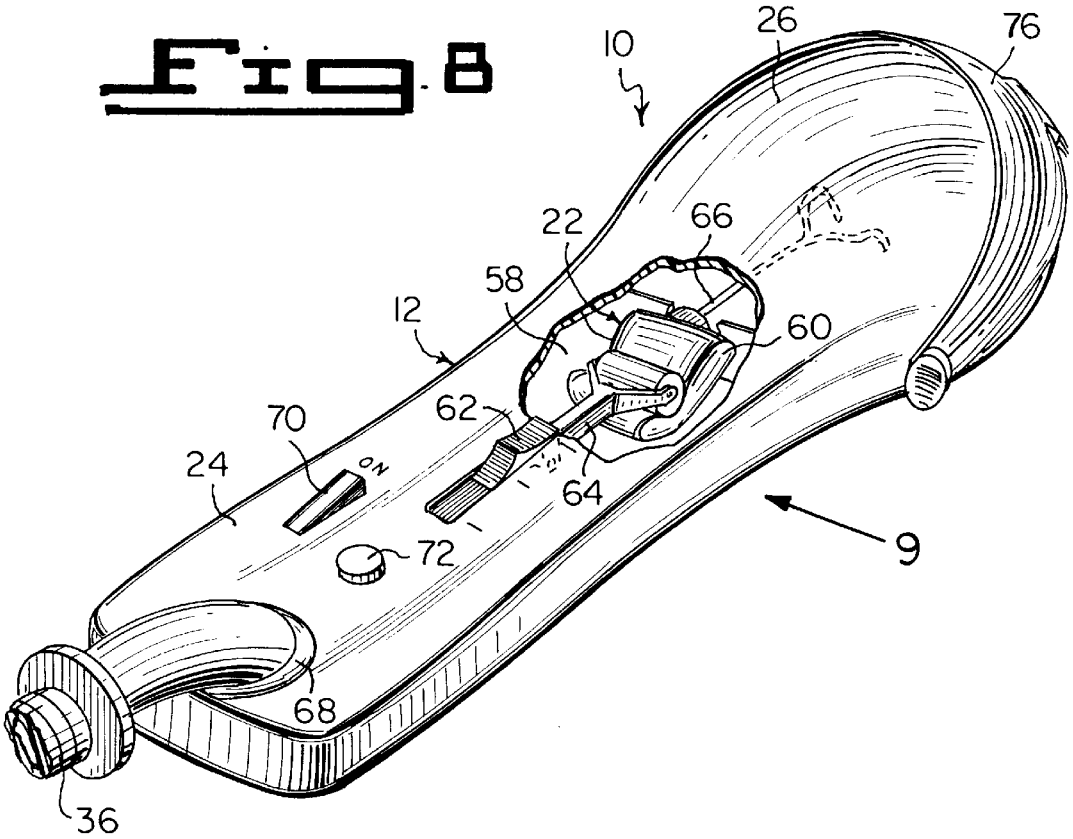
FIG. 8 is an enlarged perspective view of the hand held spray head taken in the direction of arrow 8 in FIG. 6, with parts broken away and in section.
Figure 9:
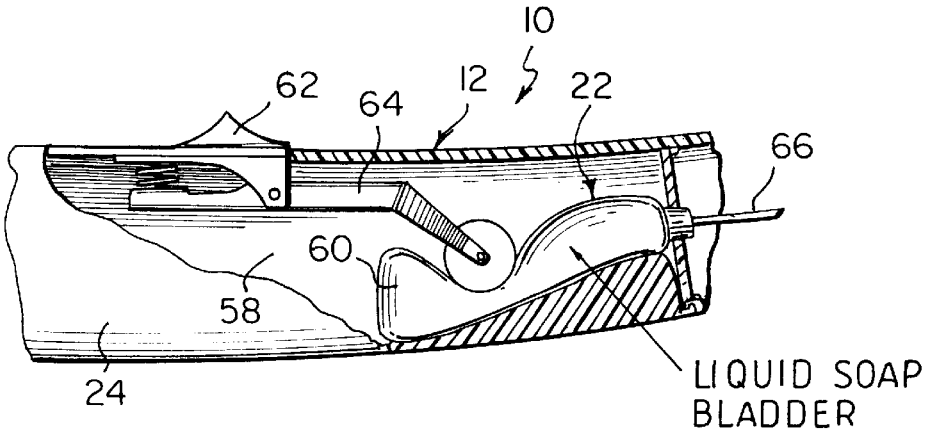
FIG. 9 is a further enlarged side view taken in the direction of arrow 9 in FIG. 8, with parts broken away and in section.

The liquid soap supplying assembly 22, as best seen in FIGS. 8 and 9, consists of the handle 24 of the hand held spray member 12 having a liquid soap compartment 58 therein. A liquid soap bladder 60 is carried within the liquid soap compartment of the handle 24. A three position slide switch 62 is on the handle 24 of the hand held spray member 12. A spring biased roller assembly 64 is operable by the slide switch 62, to engage with the liquid soap bladder 60. A conduit 66 extends from the liquid soap bladder 60 to at least one of the outlet ports 28 in the spray head 26.

The hand held spray member 12 further includes a swivel joint 68 between an end of the second flexible water hose 36 and the hand held spray member 12, allowing the hand held spray member 12 to be easily rotated and directed. The handle 24 of the hand held spray member 12 further contains a warm water switch 70, to control the flow of warm water from the warm water supplying assembly 14. A warm air drying button switch 72 controls the flow of warm air from the warm air supplying assembly 20. A cradle 74 is formed on a side of the reservoir 42, so that the hand held spray member 12 can be stored on the cradle 74 when not in use.

The hand held spray member 12 further contains an extendable brush member 76 mounted onto the sides of the spray head 26, so as to help clean the crotch area of the female person, when the extendable brush assembly 76 is in its extendable position. The hand held spray member 12, as shown in FIG. 6, can further include a replaceable snap on perforated brush member 78 mounted onto the spray head 26 over the outlet ports 28, so as to help clean the crotch area of the female person, when the snap on perforated brush assembly 78 is mounted in place.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A bidet device comprising:

a) a hand held spray member;

b) means for supplying a source of warm water to said hand held spray member, so that the warm water can be ejected from said hand held spray member and be directed to a crotch area of a female person over a bowl of a conventional toilet, said warm water supplying means including:

i) a water heater;

ii) a first flexible water hose fluidly connected between a cold water supply line and said water heater; and iii) a second flexible water hose fluidly connected between said water heater and said hand held spry member; and wherein said warm water supplying means further includes a water control valve on said second flexible water hose fluidly connected to a hot water supply line;

c) means for supplying a source of warm air to said hand held spray member, so that the warm air can be ejected from said hand held spray member and be directed to the crotch area of the female person to dry the crotch area; and d) means in said hand held spray member for supplying a source of liquid soap, so that the liquid soap can be ejected from said hand held spray member and be directed to the crotch area of the female person to help clean the crotch area.

2. A bidet device as recited in claim 1, wherein said hand held spray member includes a handle with a spray head having a plurality of outlet ports, in which at least one of said outlet ports will eject the warm water therefrom, at least one of said outlet ports will eject the warm air therefrom and at least one of said outlet ports will eject the liquid soap therefrom.

3. A bidet device as recited in claim 2, wherein said water heater includes:

a) a reservoir;

b) an electrical heating unit in said reservoir for heating water in said reservoir; and c) a temperature control knob on said reservoir for adjusting said electrical heating unit.

4. A bidet device as recited in claim 3, wherein said warm air supplying means includes:

a) a compressor in said reservoir;

b) an air inlet vent on said reservoir fluidly connected to said compressor;

c) a flexible air outlet pipe extending from said compressor through said second flexible water hose to said hand held spray member; and d) a plurality of heat exchange fins on said flexible air outlet pipe within said reservoir.

5. A bidet device as recited in claim 4, wherein said liquid soap supplying means includes:

a) said handle of said hand held spray member having a liquid soap compartment therein;

b) a liquid soap bladder carried within said liquid soap compartment of said handle;

c) a three position slide switch on said handle of said hand held spray member;

d) a spring biased roller assembly operable by said slide switch, to engage with said liquid soap bladder; and e) a conduit extending from said liquid soap bladder to said at least one of said outlet ports in said spray head.

6. A bidet device as recited in claim 5, wherein said hand held spray member further includes a swivel ball joint between an end of said second flexible water hose and said hand held spray member, so that said hand held spray member can be easily directed.

7. A bidet device as recited in claim 6, wherein said handle of said hand held spray member further includes:

a) a warm water switch to control the flow of warm water from said warm water supplying means; and b) a warm air drying button switch to control the flow of warm air from said warm air supplying means.

8. A bidet device as recited in claim 7, further including a cradle formed on a side of said reservoir, so that said hand held spray member can be stored on said cradle when not in use.

9. A bidet device as recited in claim 8, wherein said hand held spray member further includes an extendable brush member mounted onto the sides of said spray head, so as to help clean the crotch area of the female person, when said extendable brush assembly is in its extendable position.

10. A bidet device as recited in claim 9, wherein said hand held spray member further includes a replaceable snap on perforated brush member mounted onto said spray head over said outlet ports, so as to help clean the crotch area of the female person, when said snap on perforated brush assembly is mounted in place.

11. A bidet device comprising:

a) a hand held spray member;

b) means for supplying a source of warm water to said hand held spray member, so that the warm water can be ejected from said hand held spray member and be directed to a crotch area of a female person over a bowl of a conventional toilet, said warm water supplying means including:

i) a water heater, wherein said water heater includes a reservoir; an electrical heating unit in said reservoir for heating water in said reservoir; and a temperature control knob on said reservoir for adjusting said electrical heating unit;

ii) a first flexible water hose fluidly connected between a cold water supply line and said water heater; and iii) a second flexible water hose fluidly connected between said water heater and said hand held spray member;

c) means for supplying a source of warm air to said hand held spray member, so that the warm air can be ejected from said hand held spray member and be directed to the crotch area of the female person to dry the crotch area; and d) means in said hand held spray member for supplying a source of liquid soap, so that the liquid soap can be ejected from said hand held spray member and be directed to the crotch area of the female person to help clean the crotch area.

12. A bidet device as recited in claim 11, wherein said warm air supplying means includes:

a) a compressor in said reservoir;

b) an air inlet vent on said reservoir fluidly connected to said compressor;

c) a flexible air outlet pipe extending from said compressor through said second flexible water hose to said hand held spray member; and d) a plurality of heat exchange fins on said flexible air outlet pipe within said reservoir.

13. A bidet device as recited in claim 11, further including a cradle formed on a side of said reservoir, so that said hand held spray member can be stored on said cradle when not in use.

14. A bidet device comprising:

a) a hand held spray member including a handle with a spray head having a plurality of outlet ports, in which at least one of said outlet ports will eject warm water therefrom, at least one of said outlet ports will eject warm air therefrom and at least one of said outlet ports will eject liquid soap therefrom;

b) means for supplying the warm water to said hand held spray member, so that the warm water can be ejected from said hand held spray member and be directed to a crotch area of a female person over a bowl of a conventional toilet;

c) means for supplying the warm air to said hand held spray member, so that the warm air can be ejected from said hand held spray member and be directed to the crotch area of the female person to dry the crotch area; and d) means in said hand held spray member for supplying the liquid soap, so that the liquid soap can be ejected from the hand held spray member and be directed to the crotch area of the female person to help clean the crotch area, wherein the liquid soap supplying means includes; said handle of said hand held spray member having a liquid soap compartment therein; a liquid soap bladder carried within said liquid soap compartment of said handle; a three position slide switch on said handle of said hand held spray member; a spring biased roller assembly operable by said slide switch, to engage with said liquid soap bladder, and a conduit extending from said liquid soap bladder to said at least one of said outlet ports in said spray head.

15. A bidet device as recited in claim 14, wherein said warm water supplying means includes:

a) a water heater;

b) a first flexible water hose fluidly connected between a cold water supply line and said water heater; and c) a second flexible water hose fluidly connected between said water heater and said hand held spray member.

16. A bidet device comprising:

a) a hand held spray member including a swivel joint between an end of a second flexible water hose and said hand held spray member, so that said hand held spray member can be easily directed;

b) means for supplying a source of warm water to said hand held spray member, so that the warm water can be ejected from said hand held spray member and be directed to a crotch area of a female person over a bowl of a conventional toilet, said warm water supplying means including:

i) a water heater;

ii) a first flexible water hose fluidly connected between a cold water supply line and said water heater; and iii) said second flexible water hose fluidly connected between said warm heater and said hand held spray member;

c) means for supplying a source of warm air to said hand held spray member, so that the warm air can be ejected from said hand held spray member and be directed to the crotch area of the female person to dry the crotch area; and d) means in said hand held spray member for supplying a source of liquid soap, so that the liquid soap can be ejected form said hand held spray member and be directed to the crotch area of the female person to help clean the crotch area.

17. A bidet device comprising:

a) a hand held spray member including a handle with a spray head having a plurality of outlet ports, in which at least one of said outlet ports will eject warm water therefrom, at least one of said outlet ports will eject warm air therefrom and at least one of said outlet ports will eject liquid soap therefrom;

b) means for supplying the warm water to said hand held spray member, so that the warm water can be ejected from said hand held spray member and be directed to a crotch area of a female person over a bowl of a conventional toilet, c) means for supplying the warm air to said hand held spray member, so that the warm air can be ejected from said hand held spray member and be directed to the crotch area of the female person to dry the crotch area; and d) means in said hand held spray member for supplying the liquid soap, so that the liquid soap can be ejected from said hand held spray member and be directed to the crotch area of the female person to help clean the crotch area, wherein said handle of said hand held spray member further includes a warm water switch to control the flow of warm water from said water supplying means and a warm air drying button switch to control the flow of warm air from said warm air supplying means.

18. A bidet device comprising:

a) a hand held spray member including a handle with a spray head having a plurality of outlet ports, in which at least one of said outlet ports will eject warm water therefrom, at least one of said outlet ports will eject warm air therefrom and at least one of said outlet ports will eject liquid soap therefrom;

b) means for supplying the warm water to said hand held spray member, so that the warm water can be ejected from said hand held spray member and be directed to a crotch area of a female person over a bowl of a conventional toilet, c) means for supplying the warm air to said hand held spray member, so that the warm air can be ejected from said hand held spray member and be directed to the crotch area of the female person to dry the crotch area; and d) means in said hand held spray member for supplying the liquid soap, so that the liquid soap can be ejected from said hand held spray member and be directed to the crotch area of the female person to help clean the crotch area, wherein said hand held spray member further includes an extendable brush member mounted onto the sides of said spray head, so as to help clean the crotch area of the female person, when said extendable brush member is in its extendable position.

19. A bidet device comprising:

a) a hand held spray member including a handle with a spray head having a plurality of outlet ports, in which at least one of said outlet ports will eject warm water therefrom, at least one of said outlet ports will eject warm air therefrom and at least one of said outlet ports will eject liquid soap therefrom;

b) means for supplying the warm water to said hand held spray member, so that the warm water can be ejected form said hand held spray member and be directed to a crotch area of a female person over a bowl of a conventional toilet, c) means for supplying the warm air to said hand held spray member, so that the warm air can be ejected from said hand held spray member and be directed to the crotch area of the female person to dry the crotch area; and d) means in said hand held spray member for supplying the liquid soap, so that the liquid soap can be ejected form said hand held spray member and be directed to the crotch area of the female person to help clean the crotch area, wherein said hand held spray member further includes a replaceable snap on perforated brush member mounted onto said spray head over said outlet ports, so as to help clean crotch area of the female person, when said replaceable snap on perforated brush assembly is mounted in place.

* * * * *